United States Patent [19]

Goedecke

[11] Patent Number: 4,982,841

[45] Date of Patent: Jan. 8, 1991

[54] PROTECTIVE ENVELOPE FOR A CAMERA

[76] Inventor: Hans-Joachim Goedecke, Gabriel-von-Seidl-Strasse 29, 8022 Gruenwald, Fed. Rep. of Germany

[21] Appl. No.: 471,761

[22] Filed: Jan. 29, 1990

[30] Foreign Application Priority Data

Jan. 26, 1989 [DE] Fed. Rep. of Germany ... 8900878[U]

[51] Int. Cl.[5] ..... B65D 85/38

[52] U.S. Cl. ..... 206/316.2

[58] Field of Search ..... 206/316.2

[56] References Cited

U.S. PATENT DOCUMENTS

| | | | |
|---|---|---|---|
| 1,535,312 | 4/1925 | Hosking | 206/316.2 |
| 2,482,248 | 9/1949 | Coon | 206/316.2 |
| 4,033,392 | 7/1977 | Ness | 206/316.2 |
| 4,136,726 | 1/1979 | Lee | 206/316.2 |
| 4,176,701 | 12/1979 | Welgan | 206/316.2 |
| 4,751,950 | 6/1988 | Bock | 206/316.2 |

FOREIGN PATENT DOCUMENTS

| | | | |
|---|---|---|---|
| 2061691 | 6/1972 | Fed. Rep. of Germany | 206/316.2 |
| 2212138 | 7/1989 | United Kingdom | 206/316.2 |

*Primary Examiner*—William I. Price

*Attorney, Agent, or Firm*—Fleit, Jacobson, Cohn, Price, Holman & Stern

[57] ABSTRACT

In a protective envelope for a camera, in particular a video camera, consisting of a waterproof material with a front window water-tightly integrated in the protective envelope material, a supporting device for fastening a spacer is arranged inside of the protective envelope. By the spacer, a maneuvering distance can be adjusted between the front window and an autofocus system of the camera. The protective envelope can be conformed to various housing shapes.

27 Claims, 4 Drawing Sheets

PROTECTIVE ENVELOPE FOR A CAMERA

FIELD OF THE INVENTION

The present invention relates to a protective envelope for cameras, in particular video cameras, video recorders, so-called camcorders or the like.

DESCRIPTION OF THE BACKGROUND ART

A protective envelope for film cameras and photo cameras is known from West German Utility Model No. 85 08 869. This is a substantially flat envelope which is, on one end, tightly connected to an adapter ring and which has on the opposite end an opening which can be closed, and in which a window is integrated between the two ends. When the camera is in use, the objective of the camera is tightly pressed against the glass pane of the adapter ring.

Nowadays almost all video cameras, video recorders and all video camcorders are provided with autofocus systems which require that the photo lens can turn unhindered. If a conventional protective envelope as set out in the preamble of claim 1 were used for cameras of such kind, the autofocus system would be permanently obstructed, because the relative movement between the autofocus system of a video camcorder and an adapter ring would be strongly restricted. In order to ensure proper functioning of the existing autofocus systems, a secured distance from the front window of the protective envelope must be given, so that the autofocus is not prevented from actuation by abutting the front window. Another disadvantage of the known protective envelope resides in that its use is practically limited to only certain camera types of about the same form and size, because the distance from the front window is predetermined by the length of the envelope which is open at its rear end.

Finally, it is disadvantageous when the opening for grasping is at the rear end of the protective envelope. Even though this permits an unhindered view through the eyepiece, it is difficult to handle the camera from the backside through the opening, and the rear side of the camera is unprotected and exposed to environmental influences.

SUMMARY OF THE INVENTION

It is therefore the object of the present invention to provide a protective envelope which perfectly shelters and protects the articles contained therein from detrimental environmental influences, which can be produced in a simple manner and at low expenses, which can be used for any type of camera, in particular any type of video camera, without requiring any change, and in which the autofocus systems of cameras can operate unhindered and faultlessly.

This object of the invention is achieved by a protective envelope in which a supporting device for fastening a spacing means is arranged in the inside of the protective envelope, by which a maneuvering distance can be adjusted between the front window and an autofocus system of the camera, and which can be conformed to various housing shapes. Further preferred embodiments are defined in the subclaims.

The present invention proposes a protective envelope which can receive an article in its inside, in particular a camera or video camera ready for shooting, with the envelope being made of waterproof material. One side of the protective envelope, referred to as front side hereinbelow, is provided with a front window which is integrated in the material of the protective envelope in a water-tight manner. In the inside of the protective envelope there is arranged a supporting device, to which a spacing means can be fastened. This spacing means serves to fasten a camera with an autofocus system, in particular a video camera, in such manner that a sufficient distance between the front window and the autofocus system of the camera is ensured.

Preferably, the protective envelope is made of an elastic plastic material. The front side with the front window, and the top and the back sides are water-tightly sealed, and an opening which can be sealed is provided on the bottom side of the protective envelope for grasping into the interior thereof. The opening on the bottom side facilitates particularly the handling of video cameras whose operating switches are arranged substantially on the front face or in the forward lateral area. According to an advantageous embodiment of the invention a frame with a water-tightly inserted glass pane is fitted-in on the front side of the protective envelope. Preferably, the frame with the glass pane is round and defines an inner ring, around which the material of the protective envelope is placed. In order to join the material of the protective envelope and the frame to each other in a water-tight manner, it is proposed according to the invention to provide a clamping ring as an outside ring. Inside the protective envelope, on the bottom side of the frame, there is arranged a supporting device which, in an advantageous embodiment, is a bar which extends into the interior of the protective envelope and which is suitably bent downwards. The inner end of the bar is provided with a setscrew.

According to the invention, the supporting device is formed by an elongate narrow plate which has on its one end a central slot which can be slipped over the setscrew of the supporting device, so that after fastening the setscrew the spacing means extends substantially at a right angle to the front window into the interior of the protective envelope. The half of the spacing means which protrudes into the interior of the protective envelope has an elongate central slot, into which a tripod screw can be introduced. Thus, a camera can be placed on the upper side of the spacing means and be screwed from below through the slot of the spacing means by means of a tripod screw in such manner that its autofocus system is spaced from the front window at a sufficient maneuvering distance.

Preferably, the spacing means has channels or indentations which are milled in two or more places of said spacing means and which serve as predetermined bending aid. In particular, there are provided two indentations, one of which is disposed on the bottom side and the other one on the top side of the spacing means. The indentation on the bottom side is offset relative to the indentation on the top side toward the window-sided end of the spacing means. In this way, the user can make quite simply additional bends in the spacing means, if this is required by the position of the objective of the video camera. Thus, the front window of the video camera can be readily adjusted to the center of the objective.

In another advantageous embodiment of the invention a water-tightly fitted-in insert of transparent material is arranged in the area of the eyepiece of the camera. According to an advantageous embodiment the insert is circular and larger than the clearance provided therefor in the protective envelope. This offers the advantage that the insert can be turned into the inside of the protective envelope or to the outside, so that the relative distance between the insert in the area of the eyepiece and the front window can be varied, whereby the protective envelope can be applied to the most different camera types. In those cases when the protective envelope is to be used for camcorders (for instance with a VHS cassette) resting on the user's shoulder, the transparent insert can be arranged in a lateral bulge of the protective envelope. In a preferred embodiment and in accordance with commercially available conventional camera systems, the insert will be arranged in this case approximately in the forward third on the left hand side and parallel to the front window.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the claims given hereinbelow and the accompanying drawings which are given by way of illustration only, and thus are not limitative of the present invention, and wherein:

In the Figures, identical reference numerals are used for identical parts.

DETAILED DESCRIPTION OF PREFERRED EMBODIMENTS

Figure 1:
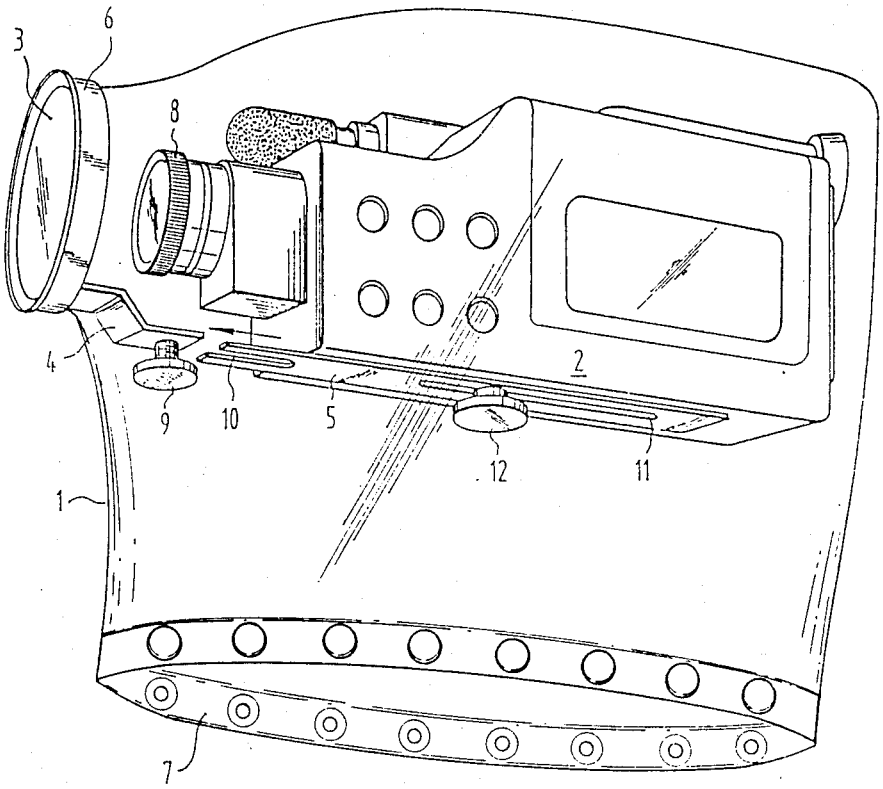
FIG. 1 is a perspective view of a protective envelope according to the invention in operation with a camera.

FIG. 1 shows a protective envelope 1 according to the invention with a camera 2 introduced therein. The camera 2 has an autofocus system 8. The front side of the protective envelope 1 is provided with a front window 3 which is attached in a water-proof manner to the material of the protective envelope by means of a clamping ring 6. A supporting device 4 is arranged on the inside edge of the front window 3. Said supporting device 4 has kinks, so that the autofocus lens is substantially centered before the front window. The end portion of the supporting device 4 which faces the interior of the protective envelope 1 is provided with a setscrew 9. The outer end portion of the spacing means 5 has a slot 10 which is slipped over the setscrew 9 for fastening the spacing means to the supporting device. The other half of the spacing means 5 which is opposite to said end portion has an elongate slot 11 extending along the central axis, in which the tripod screw 12 is arranged. The spacing means as fastened protrudes substantially at a right angle to the front window into the interior of the protective envelope The camera 2 with the tripod thread arranged therein can then be screwed on the spacing means 5 by means of the tripod screw 12 in such manner that the autofocus system 8 is sufficiently spaced from the front window 3. The camera 2 is introduced and operated through the opening 7 provided on the bottom of the protective envelope 1.

Figure 1A:
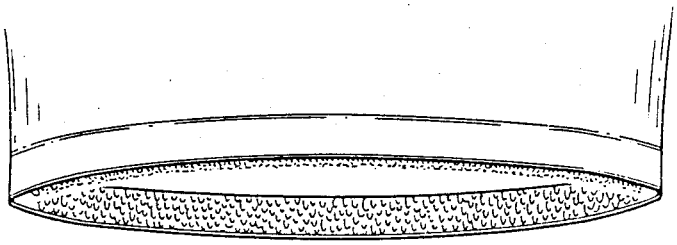
FIGS. 1*a*, 1*b* and 1*c* are schematic partial views of particular closing means for the protective envelope.
Figure 1B:
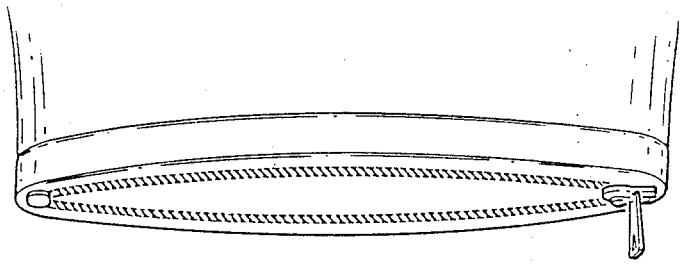
Figure 1C:
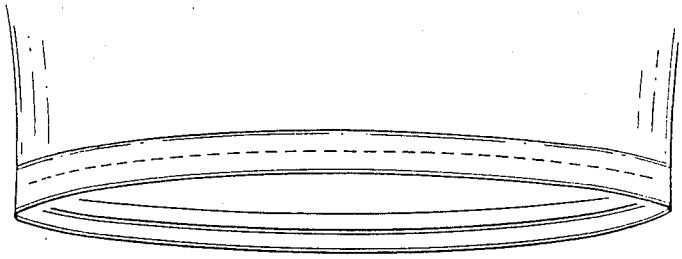

The opening 7 is provided with a closing member. The closing member can be formed in such manner that it seals the opening at several points distributed over the length thereof. It is, however, also possible to provide a closing member by means of which the opening 7 can be sealed over its entire length, e.g., a burr-like closing member, as is shown in FIG. 1*a*, or a zip fastener as illustrated in FIG. 1*b*. Furthermore, it is possible to build the closing member as a compression closing and interlocking member which can seal the opening over the entire length of the opening, as shown in FIG. 1*c*.

Figure 2:
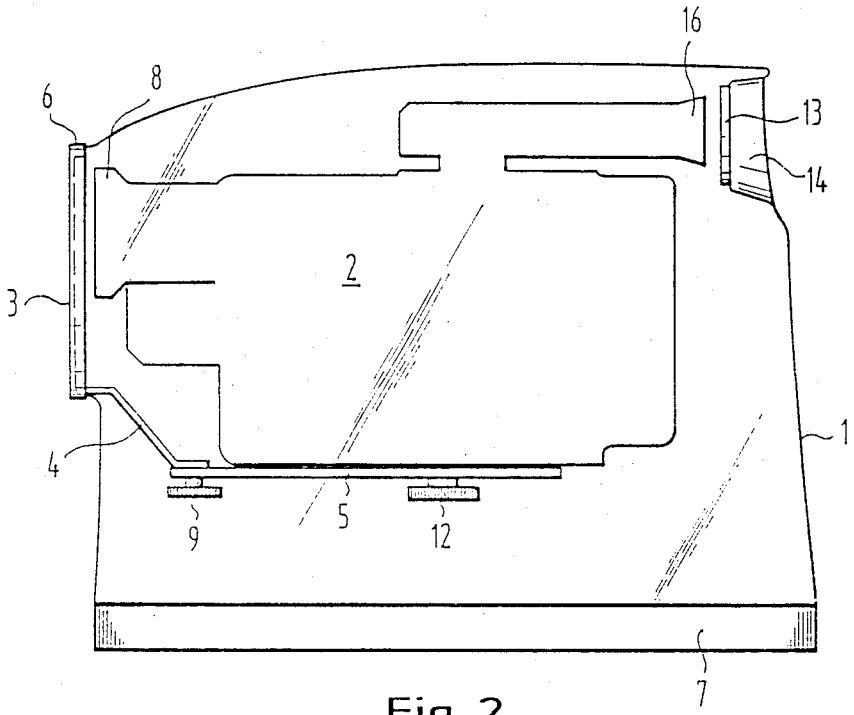
FIG. 2 is a schematic side view of a protective envelope according to the invention with a conventional short camera.

In accordance with the method described above, FIG. 2 shows a conventional camera of short design which is fastened inside the protective envelope 1 by means of the tripod screw 12 and the spacing means 5 in such manner that the autofocus system 8 is spaced from the front window at a distance sufficient to enable it to move. In this case, the eyepiece 16 of the camera is relatively far in the inside of the protective envelope 1, and therefore it is advantageous that the insert 13 which is made of transparent plastic material points inward into the position 14 turned inside.

Figure 3:
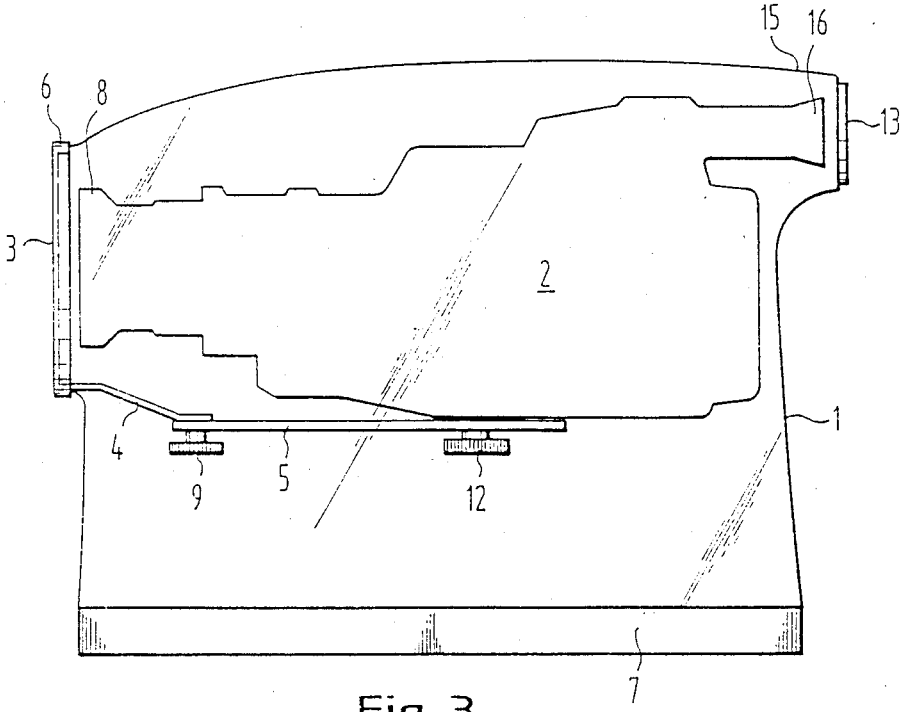
FIG. 3 is a schematic side view of a protective envelope according to the invention with a conventional camera having a long design.

FIG. 3 shows that the insert 13 of transparent plastic material points outward into position 15 turned outside when the protective envelope is used for a camera of long design.

Figure 4:
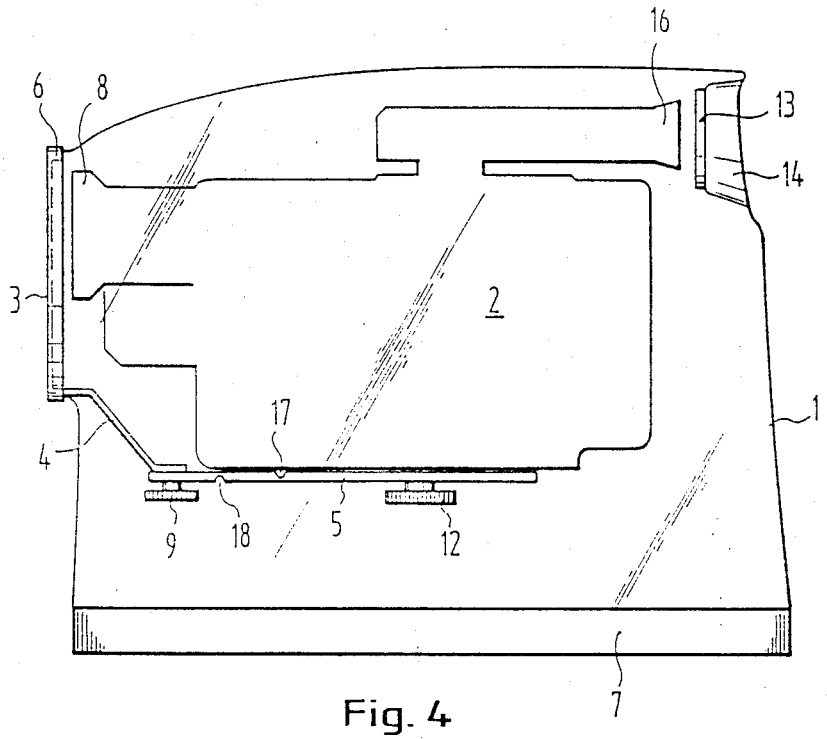
FIG. 4 is a schematic side view of a protective envelope according to the invention with an indented spacing means in a stretched condition.

In FIG. 4 the spacing means 5 is provided with indentations 17, 18 on its top and bottom sides respectively, said indentations serving as bending aid for conforming the protective envelope to the respective camera type. By means of these indentations or milled channels the spacing means can be readily conformed to the respective camera type, and in particular the objective 8 can be adjusted to the center of the front window 3. The indentation 18 on the bottom side is in this case close to the end portion of the spacing means 5 which faces the front window, quite close to the slot 10 for the setscrew 9, whereas the indentation 17 on the top side is offset toward to the rear end of the spacing means 5.

Figure 5:
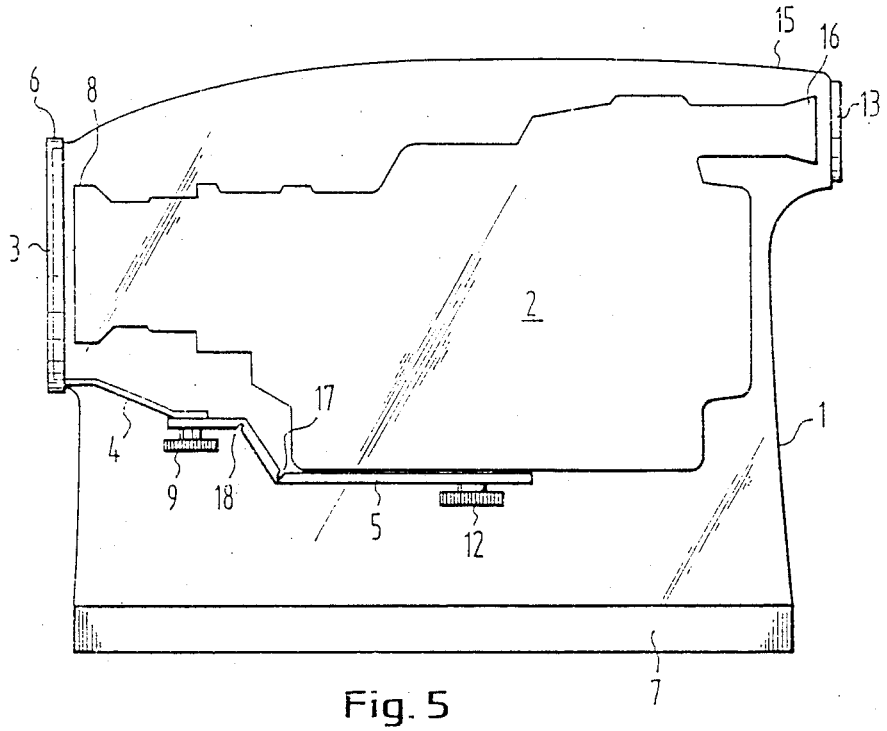
FIG. 5 is a schematic side view of a protective envelope according to the invention with an indented spacing means in a bent condition.

FIG. 5 shows a video camera 2 in a protective envelope 1 according to the invention with a spacing means 5 being bent at the indentations 17, 18. It can be clearly seen that due to this being the objective 8 can be adjusted to the center of the front window 3 in a simple manner. The distance between the objective 8 and the front window 3 can be adjusted by means of the slot 11 and the fastening screw 12 in a simple manner.

Thanks to the extraordinarily simple construction of this protective envelope, its application to any conventional camera systems can be realized at a minimum of expenses.

I claim:

1. A protective envelope for a camera, in particular a video camera, consisting of a waterproof material with a front window water-tightly integrated in the protective envelope material, characterized in that a supporting device (4) for fastening a spacing means (5) is arranged in the inside of the protective envelope (1), by which spacing means a maneuvering distance can be adjusted between the front window (3) and an autofocus system (8) of the camera (2), and that the protective envelope can be conformed to various housing shapes.

2. A protective envelope according to claim 1, characterized in that it is made of an elastic plastic material.

3. A protective envelope according to claim 1 or 2, characterized in that its top, front and back sides are water-tightly sealed and that a sealable opening (7) is provided on the bottom side for grasping into the inside of the protective envelope.

4. A protective envelope according to claim 3, characterized in that the sealable opening (7) can be sealed along lengthwise distributed points by means of an appropriate closing means.

5. A protective envelope according to claim 3, characterized in that the sealable opening (7) can be sealed over its entire length by means of an appropriate closing means.

6. A protective envelope according to claim 4, characterized in that the closing means for the sealable opening (7) is a Velcro closure.

7. A protective envelope according to claim 4, characterized in that the closing means for the sealable opening (7) is a zipper.

8. A protective envelope according to claim 4, characterized in that the closing means for the sealable opening (7) is a pressure closure.

9. A protective envelope according to claim 3, characterized in that a frame with a water-tightly inserted glass panel is fitted-in on the water-tightly sealed front side.

10. A protective envelope according to claim 9, characterized in that the frame and the material of the protective envelope are joined to each other in a water-tight manner by a clamping ring (6) placed on the outside.

11. A protective envelope according to claim 9, characterized in that the frame and glass pane are round.

12. A protective envelope according to claim 9, characterized in that the supporting device (4) for fastening the spacing means (5) is arranged on the frame.

13. A protective envelope according to claim 9, characterized in that the supporting device (4) for fastening the spacing means (5) is a bar which is fixed to the frame and which extends into the interior of the protective envelope.

14. A protective envelope according to claim 13, characterized in that the frame and the supporting device (4) are made in one piece.

15. A protective envelope according to claim 13, characterized in that the frame and the supporting device (4) are attached to each other by means of rivets.

16. A protective envelope according to claim 9, characterized in that on the side facing away from the frame the supporting device (4) for fastening the spacing means (5) has a setscrew (9).

17. A protective envelope according to claim 16, characterized in that the spacing means (5) is fastened to the supporting device (4) by means of the setscrew (9).

18. A protective envelope according to claim 16, characterized in that the spacing means (5) is an elongate plate which is on its narrow side provided with a short open slot (10) for slipping on the setscrew (9) of the supporting device (4).

19. A protective envelope according to claim 1, characterized in that the spacing means (5) is fastened to the supporting device (4) in such a manner that is extends substantially at a right angle to the front window (3) into the interior of the protective envelope.

20. A protective envelope according to claim 1, characterized in that the spacing means (5) has a closed slot (11) which extends along the longitudinal central axis of the spacing means over the half which faces the interior of the protective envelope, and which serves to receive a tripod screw (12).

21. A protective envelope according to claim 1, characterized in that the spacing means (5) has indentations (17, 18) as bending aids.

22. A protective envelope according to claim 21, characterized in that one of the indentations (17, 18) is disposed on the top side and the other one on the bottom side respectively of the spacing means (5).

23. A protective envelope according to claim 22, characterized in that the other indentation (18) is disposed on the bottom side between the end of the spacing means (5) which faces the front window (3) and the one indentation (17) on the top side of said spacing means (5).

24. A protective envelope according to claim 1, characterized in that in the area of the eyepiece (16) of the camera (2) it is provided with a substantially circular and water-tightly fitted-in insert (13) of transparent plastic material.

25. A protective envelope according to claim 24, characterized in that the transparent insert (13) is larger than the clearance provided therefor in the protective envelope and that it is substantially conical so that the insert (13) can be turned into the inside (14) of the protective envelope or to the outside (15).

26. A protective envelope according to claim 24, characterized in that the transparent insert (13) is arranged opposite the front window (3).

27. A protective envelope according to claim 24, characterized in that the transparent insert (13) is arranged in a lateral bulge of the protective envelope (1).

* * * * *